US012259206B2

(12) United States Patent
Tai et al.

(10) Patent No.: US 12,259,206 B2
(45) Date of Patent: Mar. 25, 2025

(54) LOCKING BLOCK FOR A GUN

(71) Applicants: Chen-Hung Tai, New Taipei (TW); Yong-Fong Huang, New Taipei (TW); Hwa-Nung Lee, New Taipei (TW); Yo-Lun Chang, New Tapei (TW)

(72) Inventors: Chen-Hung Tai, New Taipei (TW); Yong-Fong Huang, New Taipei (TW); Hwa-Nung Lee, New Taipei (TW); Yo-Lun Chang, New Tapei (TW)

( * ) Notice: Subject to any disclaimer, the term of this patent is extended or adjusted under 35 U.S.C. 154(b) by 113 days.

(21) Appl. No.: 18/183,852

(22) Filed: Mar. 14, 2023

(65) Prior Publication Data

US 2023/0324136 A1 Oct. 12, 2023

(30) Foreign Application Priority Data

Apr. 7, 2022 (TW) ..... 111113200

(51) Int. Cl.
*F41A 3/66* (2006.01)
*F41A 3/10* (2006.01)
*F41A 3/72* (2006.01)

(52) U.S. Cl.
CPC . *F41A 3/10* (2013.01); *F41A 3/72* (2013.01)

(58) Field of Classification Search
CPC ..... F41A 3/66; F41A 3/68
See application file for complete search history.

(56) References Cited

U.S. PATENT DOCUMENTS

| | | | | |
|---|---|---|---|---|
| 2,714,334 | A * | 8/1955 | Harvey | F41A 19/46 89/190 |
| 6,993,864 | B1 * | 2/2006 | O'Clair | F41A 5/04 42/71.02 |
| 8,851,351 | B2 * | 10/2014 | Yeh | B25C 1/047 227/8 |
| 11,022,387 | B1 * | 6/2021 | Noonan | F41A 3/66 |
| D1,030,937 | S * | 6/2024 | Burris | D22/108 |
| 2010/0263254 | A1 * | 10/2010 | Glock | F41C 23/10 42/72 |
| 2017/0321980 | A1 * | 11/2017 | Wolf | F41A 11/02 |
| 2018/0328681 | A1 * | 11/2018 | Borges | F41A 3/66 |
| 2019/0024996 | A1 * | 1/2019 | Borges | F41A 3/54 |
| 2020/0124370 | A1 * | 4/2020 | Kolev | F41A 19/10 |
| 2020/0217604 | A1 * | 7/2020 | Borges | F41A 11/02 |
| 2021/0116208 | A1 * | 4/2021 | Tai | F41C 23/18 |
| 2022/0397359 | A1 * | 12/2022 | Velasquez | F41A 19/31 |
| 2023/0104146 | A1 * | 4/2023 | Wolf | F41C 23/10 42/75.01 |
| 2023/0324136 | A1 * | 10/2023 | Tai | F41A 3/10 42/14 |

* cited by examiner

*Primary Examiner* — Derrick R Morgan
(74) *Attorney, Agent, or Firm* — Merchant & Gould P.C.

(57) ABSTRACT

A locking block is adapted to be mounted in a gun. The gun has a bias spring having a bias spring arm. The locking block includes two side bodies and a connecting body. The connecting body is connected between the two side bodies and has a bottom surface. The connecting body is formed with at least one positioning groove recessed upward from the bottom surface for catching the bias spring arm of the bias spring.

8 Claims, 9 Drawing Sheets

LOCKING BLOCK FOR A GUN

CROSS-REFERENCE TO RELATED APPLICATION

This application claims priority of Taiwanese Patent Application No. 111113200, filed on Apr. 7, 2022.

FIELD

The disclosure relates to a locking block for a gun, more particularly to a locking block that is connected to a slide of the gun for controlling movement of the slide.

BACKGROUND

A locking block of a conventional gun is made up of two side bodies and a connecting body that interconnects the two side bodies. A slide stop lever of the gun is loaded with a bias spring that has a bias spring arm resiliently braced against a bottom side of the connecting body to exert a downward resilient force on the slide stop lever.

Because the bias spring arm is merely in contact with the bottom side of the connecting body instead of being secured on the connecting body, the bias spring arm may slide against the bottom side. Therefore, the resilient force exerted by the bias spring to the slide stop lever may vary with the arm's sliding. In addition, the trigger of the gun is mounted with a return spring, and the return spring has a return spring arm abutting against the bottom side of the connecting body. Likewise, the return spring arm is only in contact but not secured to the connecting body and is slidable against the bottom side of the connecting body. Thus, the resilient force exerted by the return spring on the trigger may vary due to the return spring arm's sliding and may even interfere with the bias spring arm. The abovementioned instability, and the possible interference between the return spring arm and the bias spring arm will negatively impact the performance of the gun.

SUMMARY

Therefore, the object of the present disclosure is to provide a locking block for a gun that overcomes at least one of the disadvantages of the prior art.

According to the disclosure, a locking block is adapted to be mounted in a gun. The gun has a bias spring having a bias spring arm. The locking block includes two side bodies and a connecting body. The connecting body is connected between the two side bodies and has a bottom surface. The connecting body is formed with at least one positioning groove that is recessed upward from the bottom surface for catching the bias spring arm of the bias spring.

BRIEF DESCRIPTION OF THE DRAWINGS

Other features and advantages of the disclosure will become apparent in the following detailed description of the embodiment(s) with reference to the accompanying drawings. It is noted that various features may not be drawn to scale.

DETAILED DESCRIPTION

Figure 1:
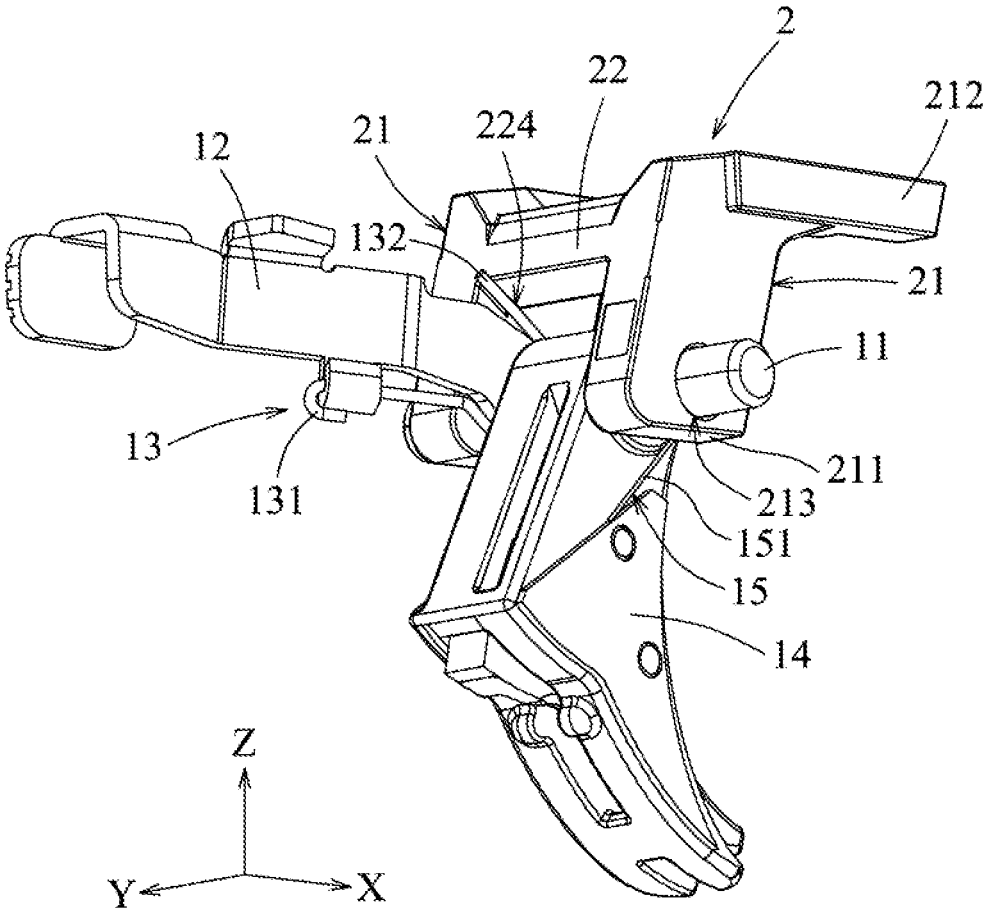
FIG. 1 is a perspective view of a first embodiment of a locking block for a gun according to the disclosure when assembled with a locking block pin, a slide stop lever, a bias spring, a trigger, and a trigger return spring.

Before the disclosure is described in greater detail, it should be noted that where considered appropriate, reference numerals or terminal portions of reference numerals have been repeated among the figures to indicate corresponding or analogous elements, which may optionally have similar characteristics.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Figure 2:
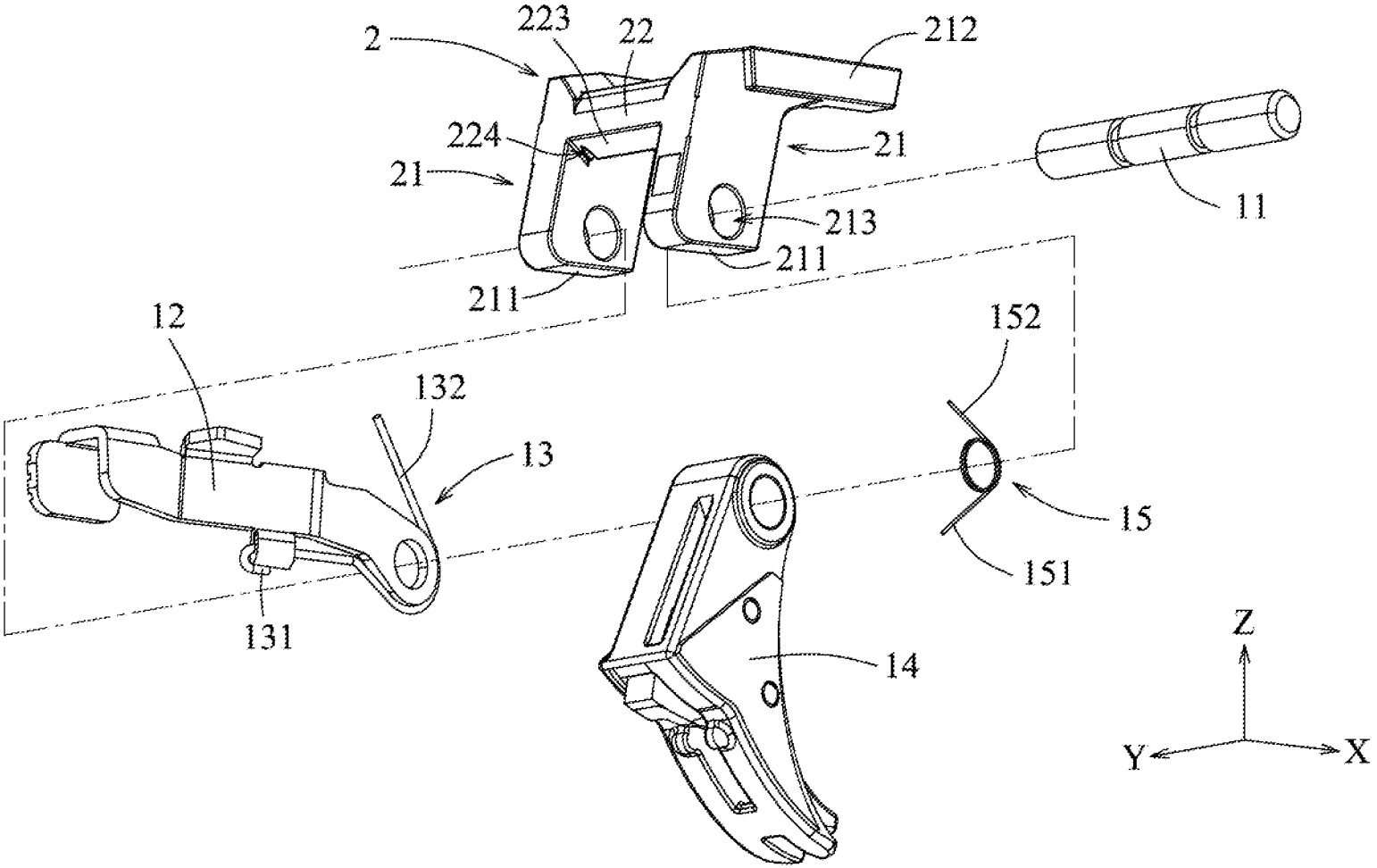
FIG. 2 is an exploded perspective view of the first embodiment, the locking block pin, the slide stop lever, the bias spring, the trigger, and the trigger return spring.

As shown in FIGS. 1 and 2, the first embodiment of the locking block 2, according to the present disclosure, is adapted to be mounted in a gun. The gun is exemplified as a Glock pistol that includes a locking block pin 11, a slide stop lever 12, a bias spring 13, a trigger 14, and a trigger return spring 15.

The locking block pin 11 is adapted to extend in a left-right direction (Y) through a frame of the gun (not shown). The slide stop lever 12 is pivotably mounted to the locking block pin 11 and is adapted to be partly accommodated in the frame of the gun. The bias spring 13 is installed for biasing the slide stop lever 12 and is formed by bending a spring steel wire. The bias spring 13 has one bias spring arm 131 engaged with the slide stop lever 12, and another bias spring arm 132 extending obliquely above the slide stop lever 12. The bias spring 13 exerts a downward resilient force on the slide stop lever 12. The trigger 14 is pivotably mounted to the locking block pin 11 and is adapted to be partly accommodated in the frame of the gun. The trigger 14 is disposed on the right side of the slide stop lever 12 and the bias spring 13. The trigger return spring 15 is a torsion spring formed by bending a spring steel wire. The trigger return spring 15 is mounted around the locking block pin 11 and disposed on the right side of the trigger 14. The trigger return spring 15 has one return spring arm 151 attached to the trigger 14, and another return spring arm 152 extending obliquely above the locking block pin 11.

Figure 3:
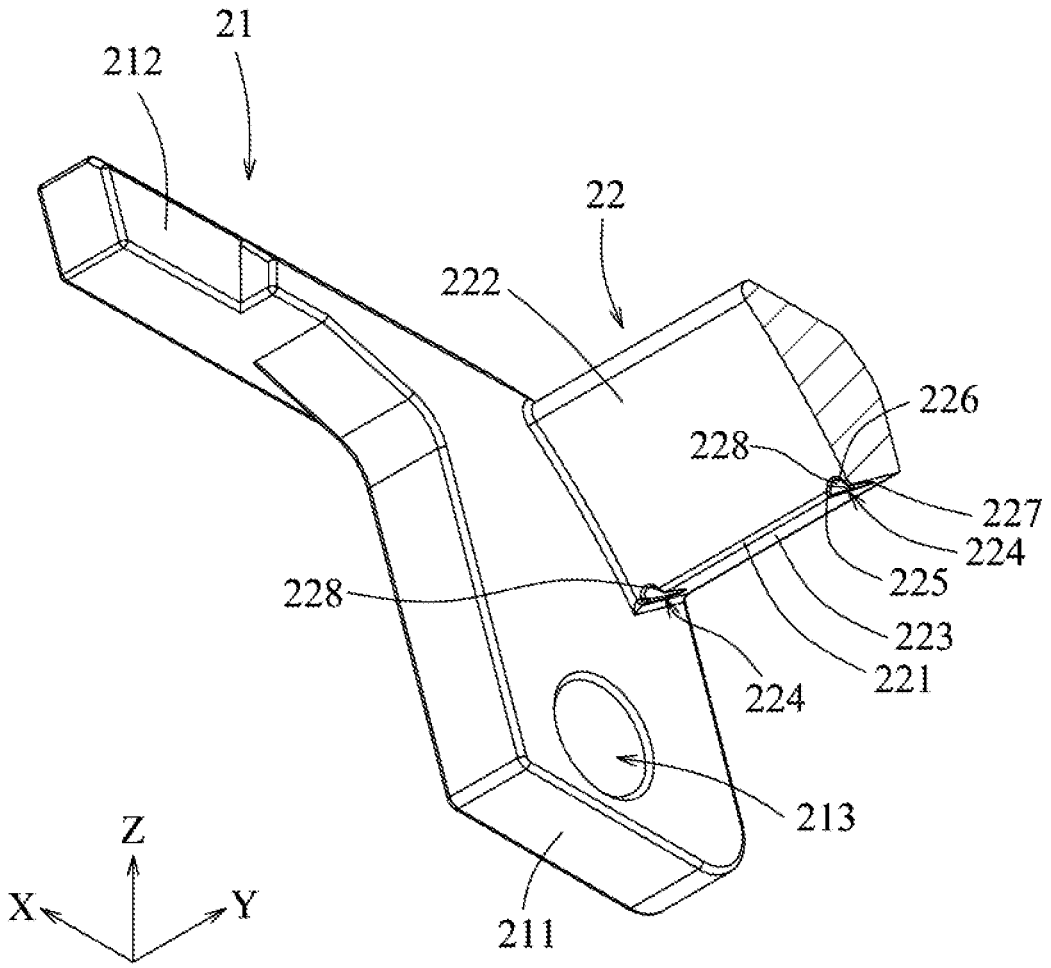
FIG. 3 is a fragmentary perspective view of the first embodiment.
Figure 4:
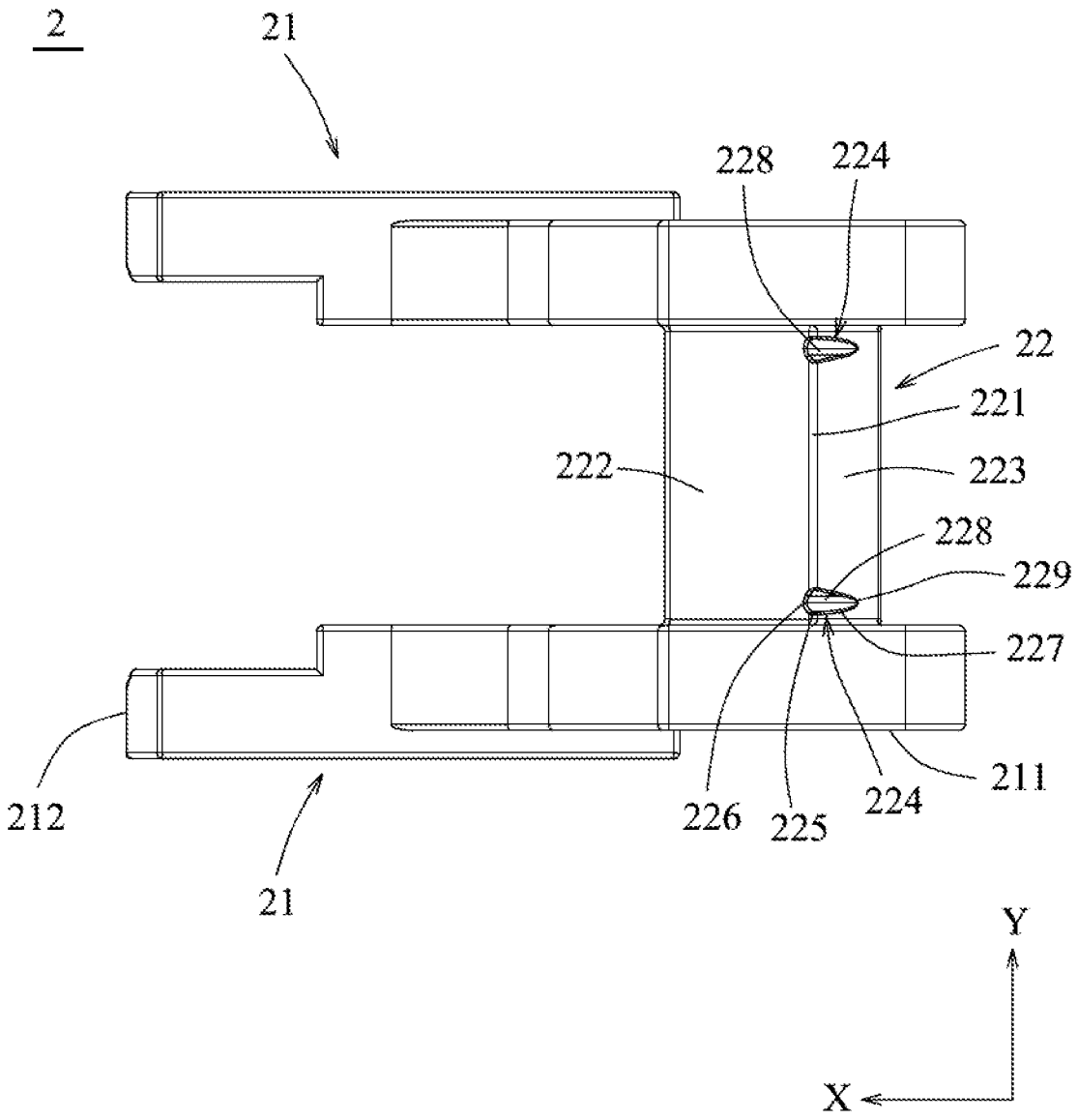
FIG. 4 is a bottom view of the first embodiment.
Figure 5:
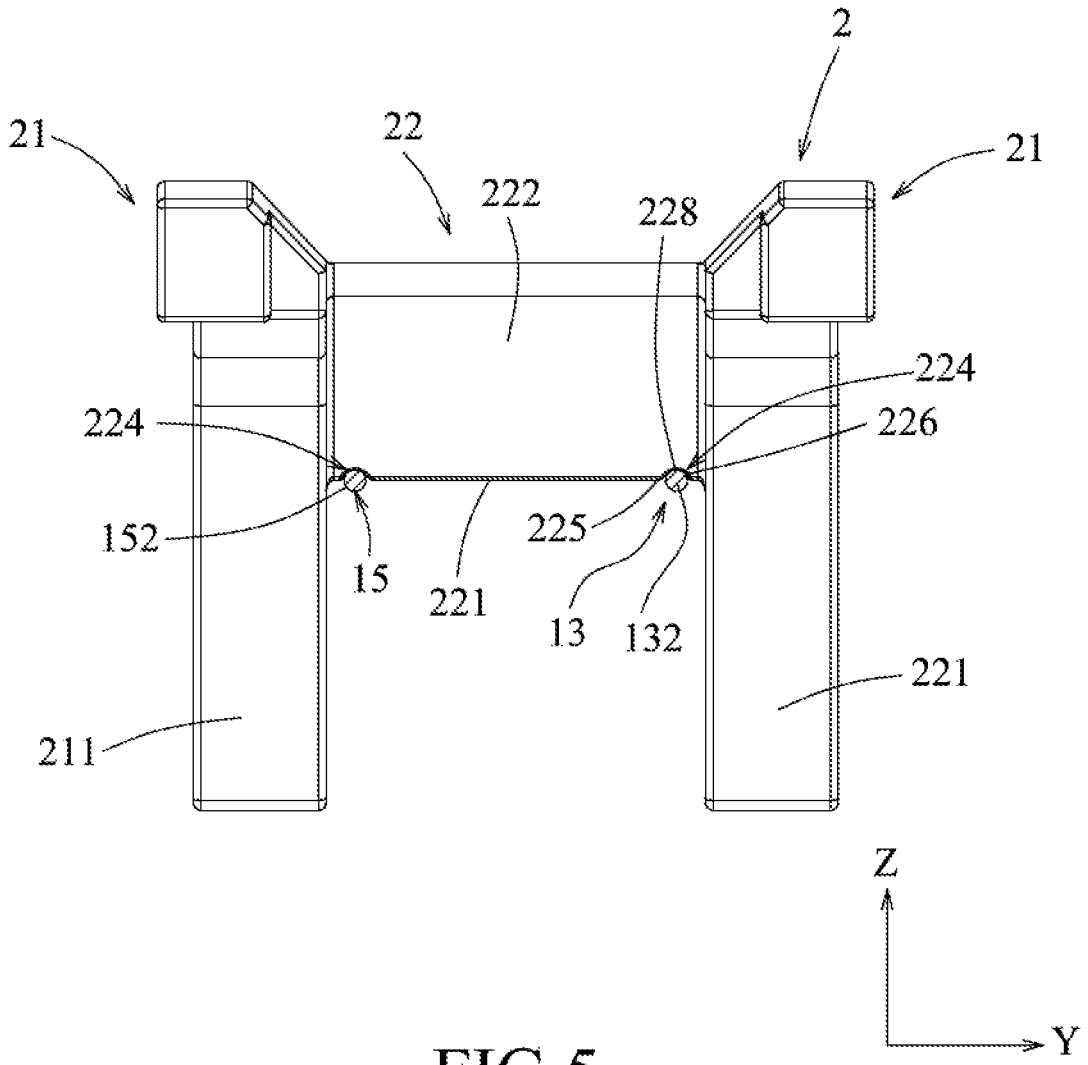
FIG. 5 is a fragmentary and partially cross-sectional front view of the first embodiment, the bias spring and a return spring arm of the trigger return spring.
Figure 6:
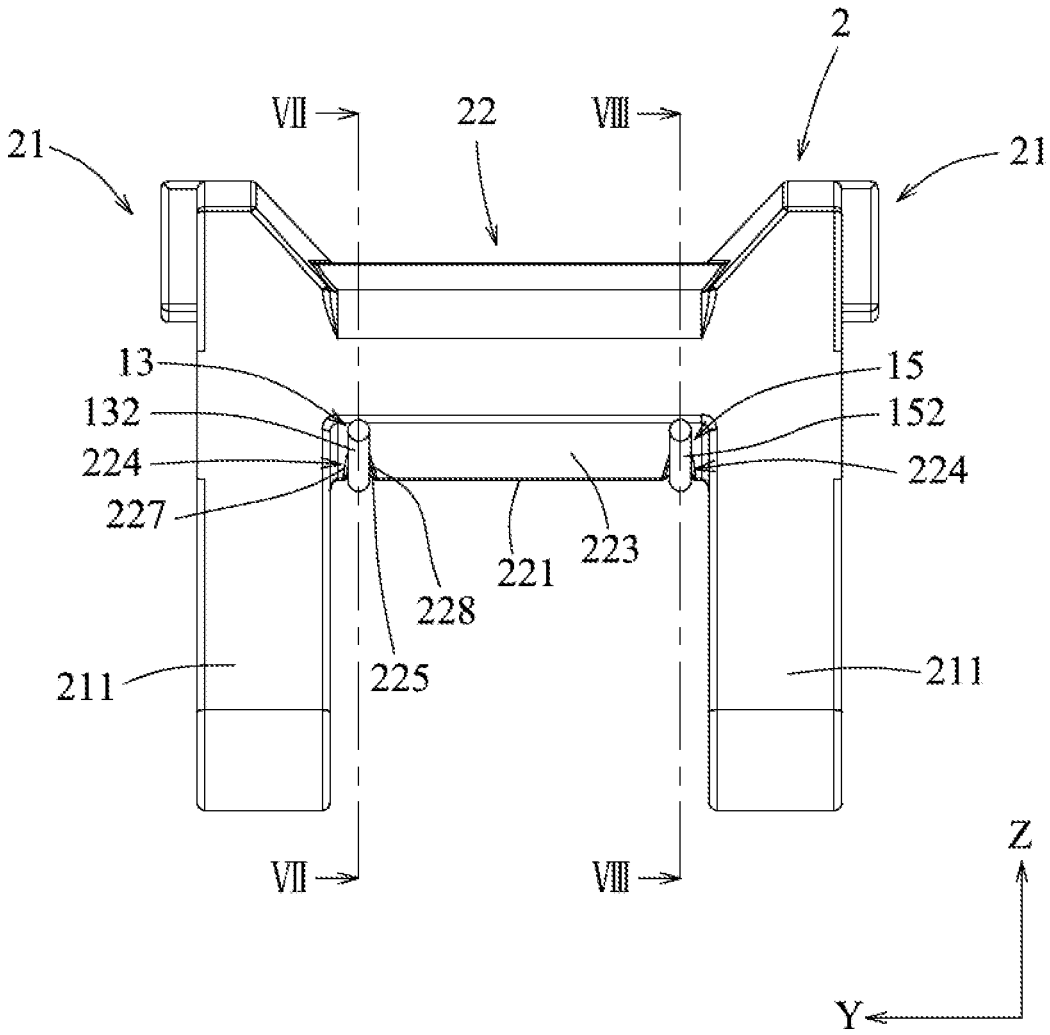
FIG. 6 is a fragmentary rear view of the first embodiment, the bias spring arm and the return spring arm, with the latter two being respectively caught in two positioning grooves of the embodiment.
Figure 7:
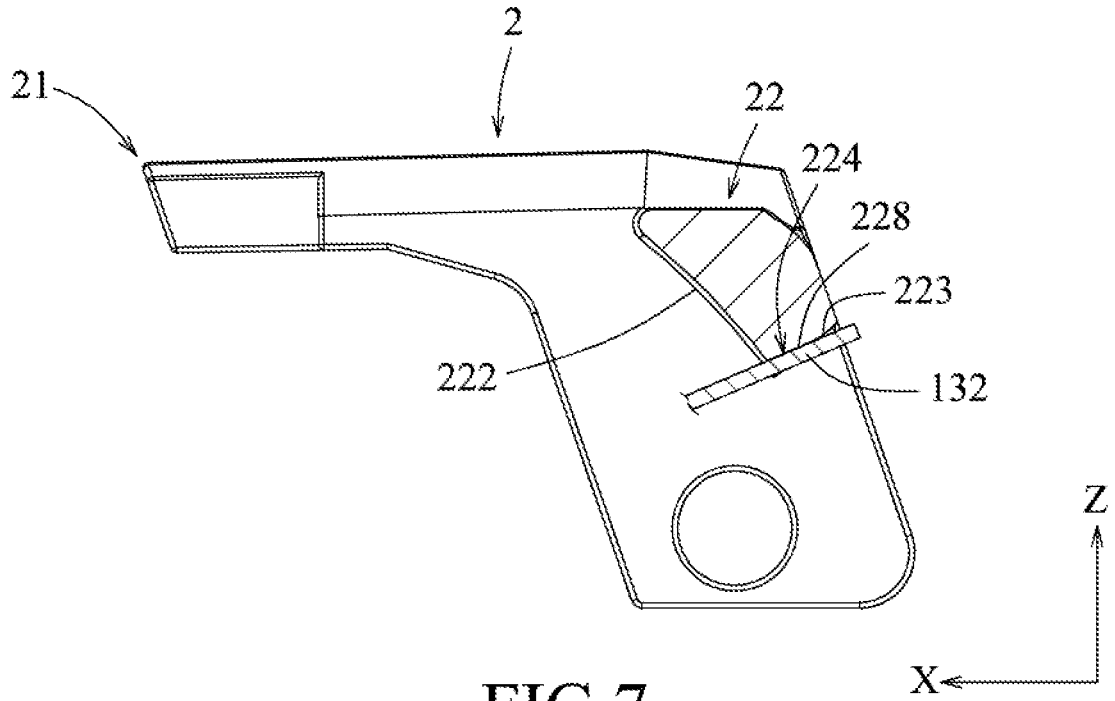
FIG. 7 is a fragmentary sectional view taken along line VII-VII in FIG. 6.
Figure 8:
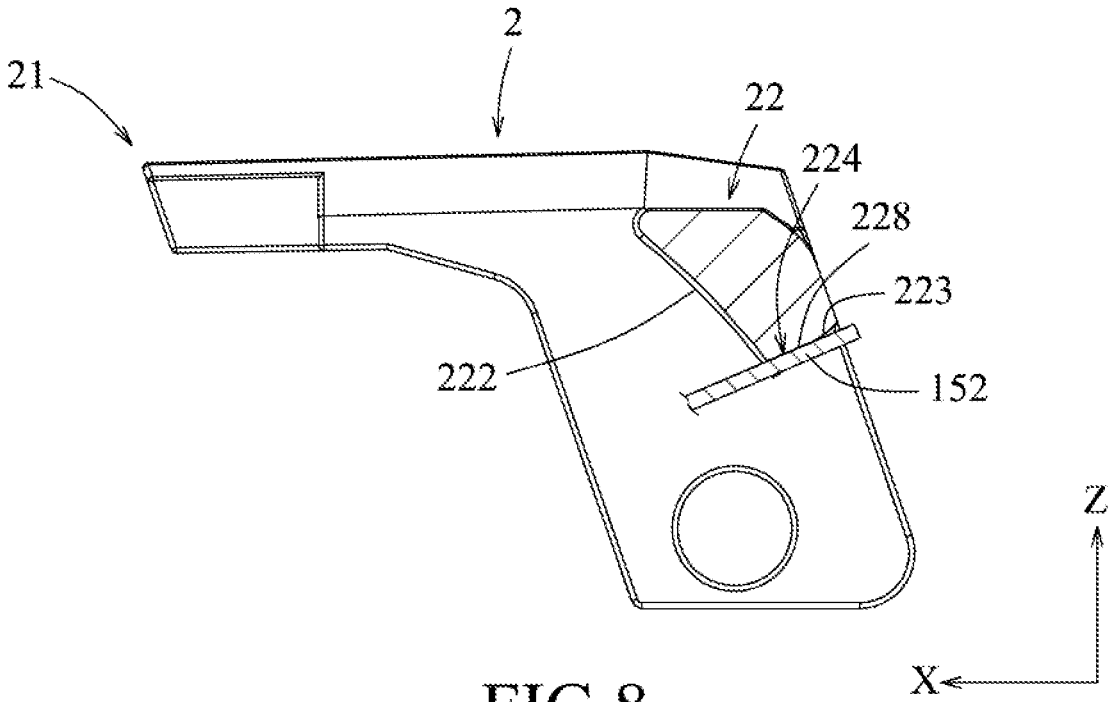
FIG. 8 is a fragmentary sectional view taken along line VIII-VIII in FIG. 6.

Referring to FIGS. 2 to 4, the locking block 2 includes two side bodies 21 spaced apart in the left-right direction (Y), and a connecting body 22 connected between the two side bodies 21. Each side body 21 has a leg portion 211 adapted to be accommodated in the frame of the gun, and a rail portion 212 connected to the top of the leg portion 211 and adapted to be in contact with the top of the frame of the gun. The leg portion 211 is formed with a pin hole 213 for the locking block pin 11 to pass through. The rail portion 212 extends in a front-rear direction (X) perpendicular to the left-right direction (Y) and is positioned above the pin hole 213. The connecting body 22 has a bottom surface 221, a front connecting surface 222 that is disposed in front of and connected to the front edge of the bottom surface 221, and a rear connecting surface 223 that is disposed behind and connected to the rear edge of the bottom surface 221. In the first embodiment, the bottom surface 221 is exemplified as a curved chamfer surface. The front connecting surface 222 is exemplified to extend obliquely, forwardly and upwardly from the front edge of the bottom side 221. The rear connecting surface 223 is exemplified to extend obliquely, rearwardly and upwardly from the rear edge of the bottom side 221. The connecting body 22 is formed with two positioning grooves 224 recessed upward from the bottom surface 221. The positioning grooves 224 are formed by, for example, cutting. The two positioning grooves 224 are spaced apart in the left-right direction (Y) and are adjacent to the two side bodies 21, respectively. The two positioning grooves 224 are adapted to catch the bias spring arm 132 of the bias spring 13 and the return spring arm 152 of the trigger return spring 15, respectively.

Each positioning groove 224 extends in the front-rear direction (X). It has a lower opening section 225 formed in the bottom surface 221 and facing downward, a front opening section 226 formed in the front connecting surface 222 and spatially connected to a front end of the lower opening section 225, and a rear opening section 227 formed in the rear connecting surface 223 and spatially connected to a rear end of the lower opening section 225. The lower opening section 225 has a width in the left-right direction (Y) greater than outer diameters of the bias spring arm 132 and the return spring arm 152, so that each of the bias spring arm 132 and the return spring arm 152 can be easily inserted in the lower opening section 225 of the respective positioning groove 224 during assembly of the locking block 2. The front opening section 226 and the rear opening section 227 of each positioning groove 224 are disposed for insertion of the respective one of the bias spring arm 132 and the return spring arm 152 so that the positioning grooves 224 are suitable for accommodating bias spring arms 132 and return spring arms 152 of different lengths. The rear opening section 227 has a width in the left-right direction (Y) gradually decreasing rearwards, so as to prevent the respective one of the bias spring arm 132 and the return spring arm 152 from shaking in the left-right direction (Y).

In the first embodiment, the connecting body 22 further has two curved recessed surfaces 228 that respectively define the two positioning grooves 224. Each curved recessed surface 228 is formed between the front connecting surface 222 and the rear connecting surface 223. Each of the curved recessed surfaces 228 has a contour that corresponds to that of the outer peripheral surfaces of the respective one of the bias spring arm 132 and the return spring arm 152 in order to increase the contact area between the curved recessed surfaces 228 and the bias spring arm 132 and the return spring arm 152, so that the bias spring arm 132 and the return spring arm 152 can be firmly held in the positioning grooves 224 without shaking left and right.

More specifically, each curved recessed surface 228 extends obliquely, rearwardly and upwardly from the front connecting surface 222 to the rear connecting surface 223 in order to increase the contact length between the curved recessed surface 228 and the respective one of the bias spring arm 132 and the return spring arm 152, so that the bias spring arm 132 and the return spring arm 152 can be further firmly held in the positioning grooves 224. In another aspect, each positioning groove 224 has a depth in an up-down direction (Z) that is perpendicular to the front-rear direction (X) and the left-right direction (Y) being decreased gradually rearwards. The rear opening section 227 of each positioning groove 224 has a rear end 229 that is disposed at a middle portion of the rear connecting surface 223. Since the rear opening section 227 of each positioning groove 224 does not extend the entire width of the rear connecting surface 223 in the front-rear direction (X), the rear opening section 227 of each positioning groove 224 will require less cutting.

Referring to FIGS. 5 to 8, during assembly of the gun, when the locking block 2 is assembled downwardly from the top of the frame of the gun, the slide stop lever 12 (as seen in FIG. 1), the bias spring arm 132 of the bias spring 13, a top portion of the trigger 14 (as seen in FIG. 1), and the return spring arm 152 of the trigger return spring 15 are accommodated between the two leg portions 211 of the side bodies 21. Since the two positioning grooves 224 are adjacent respectively to the two side bodies 21, and since the width of the lower opening sections 225 of the positioning grooves 224 is greater than the outer diameters of the bias spring arm 132 and the return spring arm 152, the bias spring arm 132 and the return spring arm 152 can be positioned respectively into the positioning grooves 224 through the lower opening sections 225 during the downward movement of the locking block 2 without additional adjustment.

After the locking block 2 is assembled to the frame of the gun, the curved recessed surfaces 228 are respectively held against the bias spring arm 132 and the return spring arm 152, and respectively exert downward forces thereon so that the bias spring 13 and the trigger return spring 15 will exert resilient forces on the slide stop lever 12 and the trigger 14, respectively. Since the curved recessed surfaces 228 abut against top portions of the bias spring arm 132 and the return spring arm 152, and since the curved recessed surfaces 228 and the rear opening sections 227 of the positioning grooves 224 work together to prevent the bias spring arm 132 and the return spring arm 152 from shaking left and right, the bias spring arm 132 and the return spring arm 152 are firmly caught in the positioning grooves 224 and will not slide relative to the connecting body 22, thereby facilitating the bias spring 13 and the trigger return spring 15, to respectively exert stable resilient forces on the slide stop lever 12 and the trigger 14. Besides, the bias spring arm 132 and the return spring arm 152 can be prevented from mutual contact and interference to improve the performance of the gun.

It should be noted that the gun, as mentioned above, is illustrated with a model suitable for left-handed users. The slide stop lever 12 and the bias spring 13 are arranged on the left side of the trigger 14, and the trigger return spring 15 is arranged on the right side of the trigger 14, so the bias spring arm 132 and the return spring arm 152 are respectively caught in the left one and the right one of the positioning grooves 224. For the model suitable for right-handed users, the slide stop lever 12 and the bias spring 13 are arranged on the right side of the trigger 14, and the trigger return spring 15 is arranged on the left side of the trigger 14, which means that the return spring arm 152 and the bias spring arm 132 are respectively caught in the left one and the right one of the positioning grooves 224. In this way, the locking block 2 with the positioning groove 224 can be applied to guns for both types of users.

Figure 9:
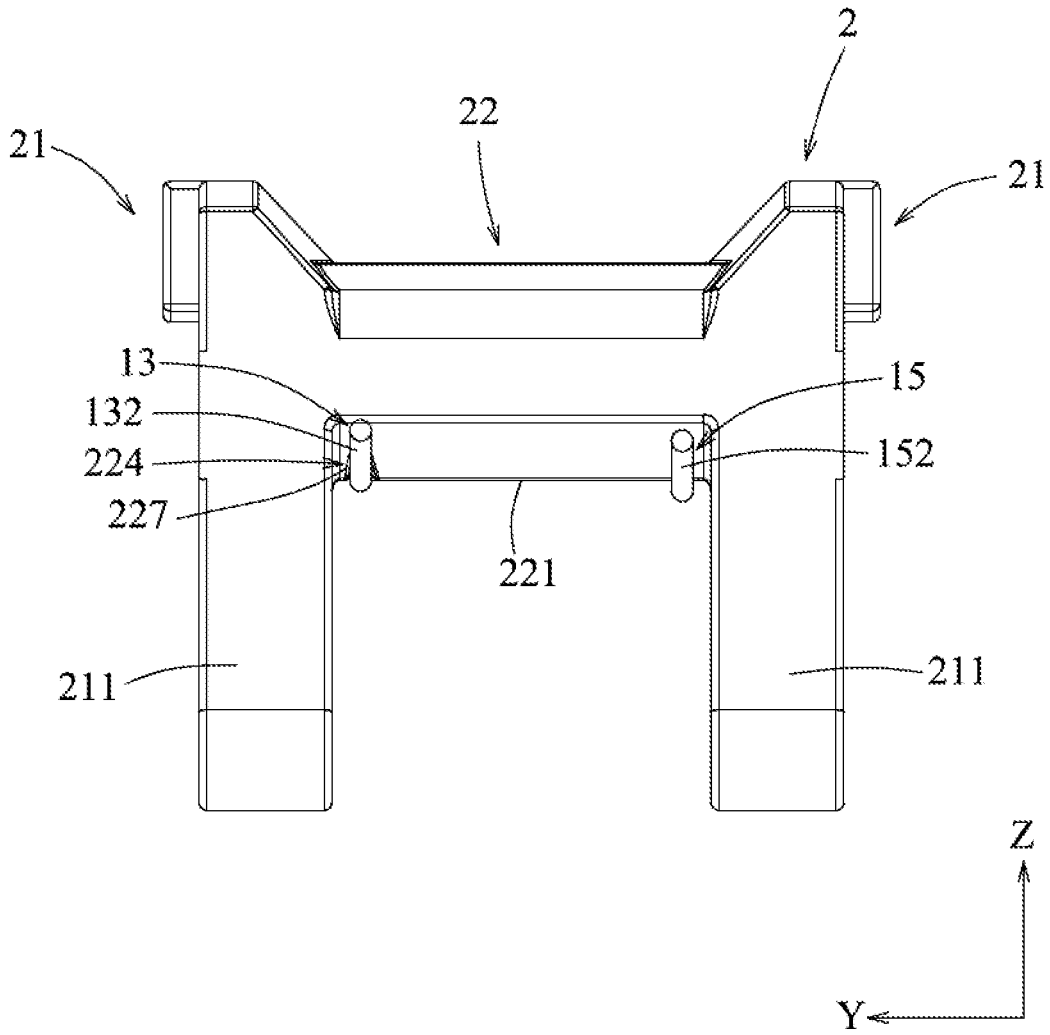
FIG. 9 is a fragmentary rear view of a second embodiment of the locking block according to the present disclosure, the bias spring arm of the bias spring and the return spring arm of the return spring.

As shown in FIG. 9, the second embodiment of the locking block 2 according to the disclosure has a structure similar to that of the first embodiment. The main difference between this embodiment and the previous embodiment resides in the number of positioning grooves 224.

In the second embodiment, there is only one positioning groove 224, which is adjacent to the left one of the side bodies 21 to catch the bias spring arm 132 of the bias spring 13. The return spring arm 152 of the trigger return spring 15 abuts against the bottom surface 221 of the connecting body 22 adjacent to the right one of the side bodies 21.

Figure 10:
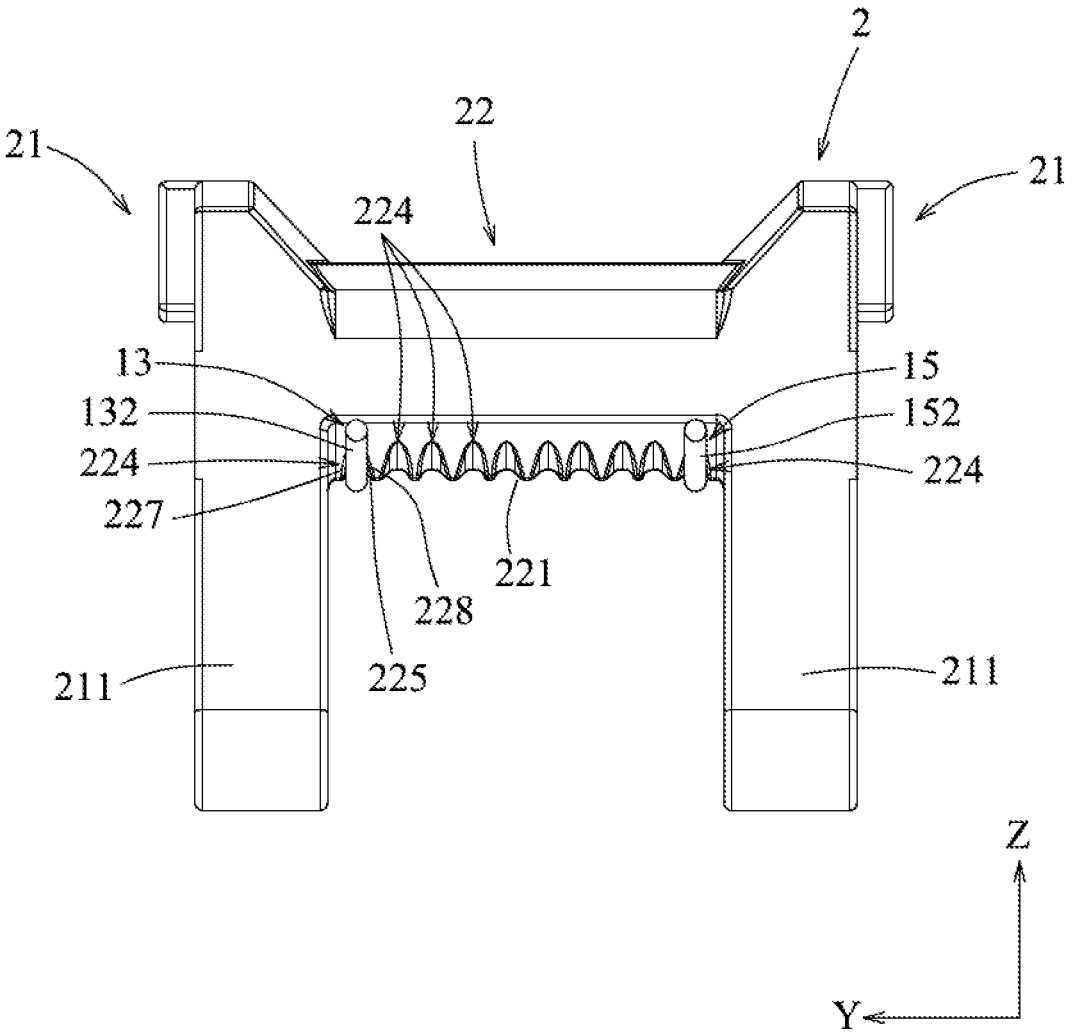
FIG. 10 is a fragmentary rear view of a third embodiment of the locking block according to the present disclosure, the bias spring arm of the bias spring and the return spring arm of the return spring.

As shown in FIG. 10, the third embodiment of the locking block 2 according to the disclosure has a structure similar to that of the first embodiment. The main difference between this embodiment and the first embodiment resides in the number of positioning grooves 224.

In the third embodiment, the number of the positioning grooves 224 is more than two, for example, there may be ten positioning grooves 224. As such, the bottom surface 221 of the connecting body 22 has a corrugated shape. Any two of the positioning grooves 224 can be used to catch the bias spring arm 132 of the bias spring 13 and the return spring arm 152 of the trigger return spring 15, respectively. Therefore, when the positions of the return spring arm 152 and the torsion bias spring arm 132 are different from those of the first embodiment in the left-right direction (Y), it can still be ensured that they are caught in a corresponding pair of the positioning grooves 224.

In brief, the locking block 2 of each embodiment has at least one positioning groove 224 to catch the bias spring arm 132 of the bias spring 13 so that the bias spring arm 132 will not slide relative to the connecting body 22. The resilient force exerted by the bias spring 13 on the slide stop lever 12 can maintain stable. The bias spring arm 132 and the return spring arm 152 can be prevented from mutual contact and interference, thereby improving the performance of the gun which achieves the purpose of the present disclosure.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is(are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A locking block adapted to be mounted in a gun, the gun having a bias spring that has a bias spring arm, said locking block comprising:

two side bodies; and a connecting body connected between said two side bodies and having a bottom surface, said connecting body being formed with at least one positioning groove that is recessed upward from said bottom surface, the at least one positioning groove being defined by at least one curved recessed surface for catching said bias spring arm of said bias spring.

2. The locking block as claimed in claim 1, wherein said at least one positioning groove is adjacent to one of said two side bodies.

3. The locking block as claimed in claim 1, wherein said at least one positioning groove extends in a front-rear direction and has:

a lower opening section having a width in a left-right direction perpendicular to said front-rear direction that is greater than an outer diameter of said bias spring arm;

a front opening section disposed in front of and spatially connected to a front end of said lower opening section; and a rear opening section disposed behind and spatially connected to a rear end of said lower opening section, and having a width in said left-right direction that gradually decreases rearwards.

4. The locking block as claimed in claim 3, wherein said connecting body further has a front connecting surface that is disposed in front of and connected to said bottom surface, and a rear connecting surface that is disposed behind and connected to said bottom surface, and said at least one curved recessed surface is disposed between said front connecting surface and said rear connecting surface.

5. The locking block as claimed in claim 4, wherein said curved recessed surface extends obliquely, rearwardly and upwardly from said front connecting surface to said rear connecting surface.

6. The locking block as claimed in claim 4, wherein:

said front connecting surface extends obliquely, forwardly and upwardly from a front edge of said bottom surface;

said rear connecting surface extends obliquely, rearwardly and upwardly from a rear edge of said bottom surface;

said at least one positioning groove has a depth in an up-down direction that is perpendicular to said front-rear direction and said left-right direction being decreased gradually rearwards; and said rear opening section of said at least one positioning groove has a rear end disposed at a middle portion of said rear connecting surface.

7. The locking block as claimed in claim 1, wherein said at least one positioning groove includes two positioning grooves that are respectively adjacent to said two side bodies, and that are adapted for respectively catching said bias spring arm of said bias spring and a return spring arm of a trigger return spring.

8. The locking block as claimed in claim 1, wherein:

said at least one positioning groove includes more than two positioning grooves, such that said bottom surface has a corrugated shape; and two of said positioning grooves are adapted for respectively catching said bias spring arm of said bias spring and a return spring arm of a trigger return spring.

* * * * *